United States Patent [19]

Inman

[11] 4,074,791

[45] Feb. 21, 1978

[54] EMERGENCY FIRE NET

[76] Inventor: Johnny K. Inman, 1205 Clearview Drive, Atlanta, Ga. 30319

[21] Appl. No.: 667,377

[22] Filed: Mar. 16, 1976

[51] Int. Cl.[2] ..... A62B 1/22

[52] U.S. Cl. ..... 182/138

[58] Field of Search ..... 182/140, 139, 138, 137, 182/82, 57, 56, 55; 272/65

[56] References Cited

U.S. PATENT DOCUMENTS

| | | | |
|---|---|---|---|
| 462,934 | 11/1891 | Thibault | 182/57 |
| 929,034 | 7/1909 | Skelly | 182/56 |
| 3,502,330 | 3/1970 | Cheftel | 182/140 |
| 3,672,174 | 6/1972 | Hippel | 248/354 H |
| 3,679,026 | 7/1972 | Hansen | 182/82 |
| 3,747,708 | 7/1973 | Wenger | 182/152 |
| 3,805,916 | 4/1974 | Milam | 182/138 |

FOREIGN PATENT DOCUMENTS

| | | | |
|---|---|---|---|
| 1,196,679 | 5/1959 | France | 182/138 |
| 950,755 | 10/1956 | Germany | 182/138 |

*Primary Examiner*—Reinaldo P. Machado

*Attorney, Agent, or Firm*—Clarence A. O'Brien; Harvey B. Jacobson

[57] ABSTRACT

An emergency escape structure is provided for use on the exteriors of high buildings having outwardly projecting vertically spaced balcony structures. The escape structure includes a vertically extendable upright mounting structure for vertical expansion between, tight frictional engagement with and anchoring between the upper and under surfaces of adjacent vertically spaced lower and upper balcony structures. A horizontal support frame is supported from and projects outwardly of the mounting structure intermediate the upper and lower ends thereof and the support frame includes a generally horizontally disposed flexible catch structure supported therefrom at points spaced about the periphery of the catch structure. Further, the escape structure may have its mounting portion mounted within a room of a building adjacent the outer wall of that room and with the net portion of the escape structure projected through a window opening in the outer wall.

6 Claims, 7 Drawing Figures

Fig. 1
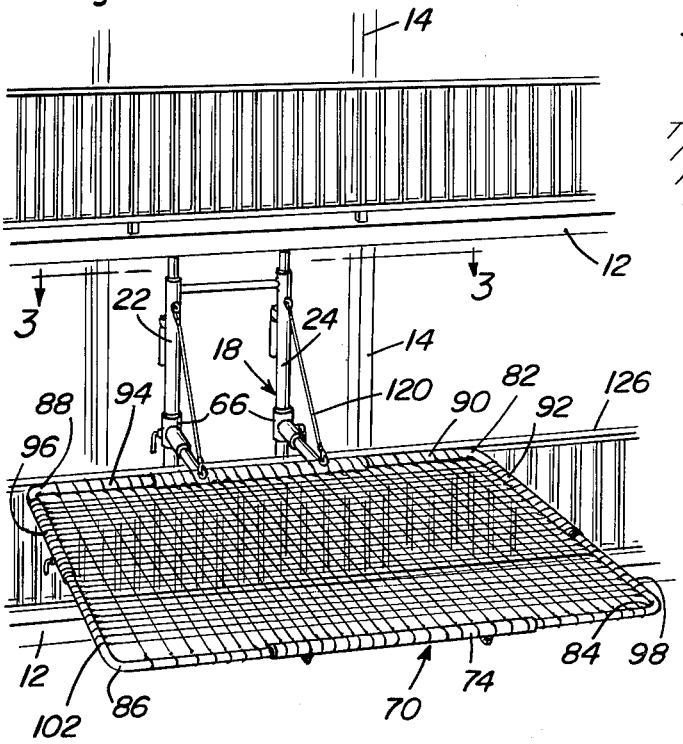
Fig. 7
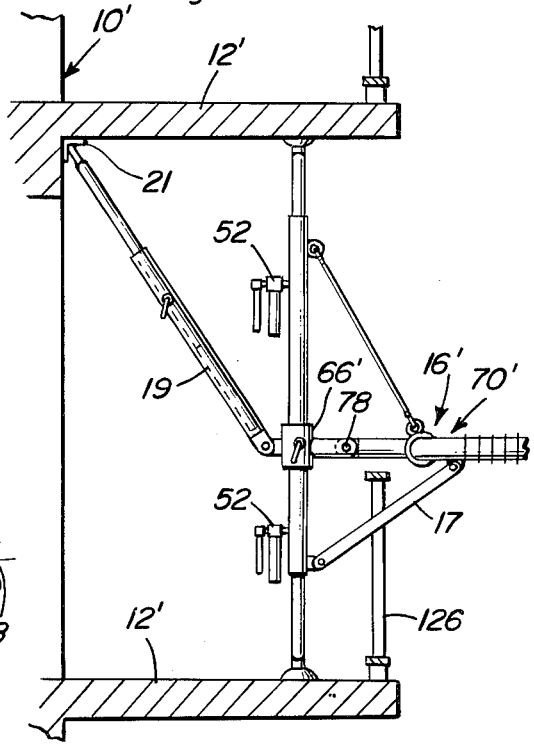
Fig. 2
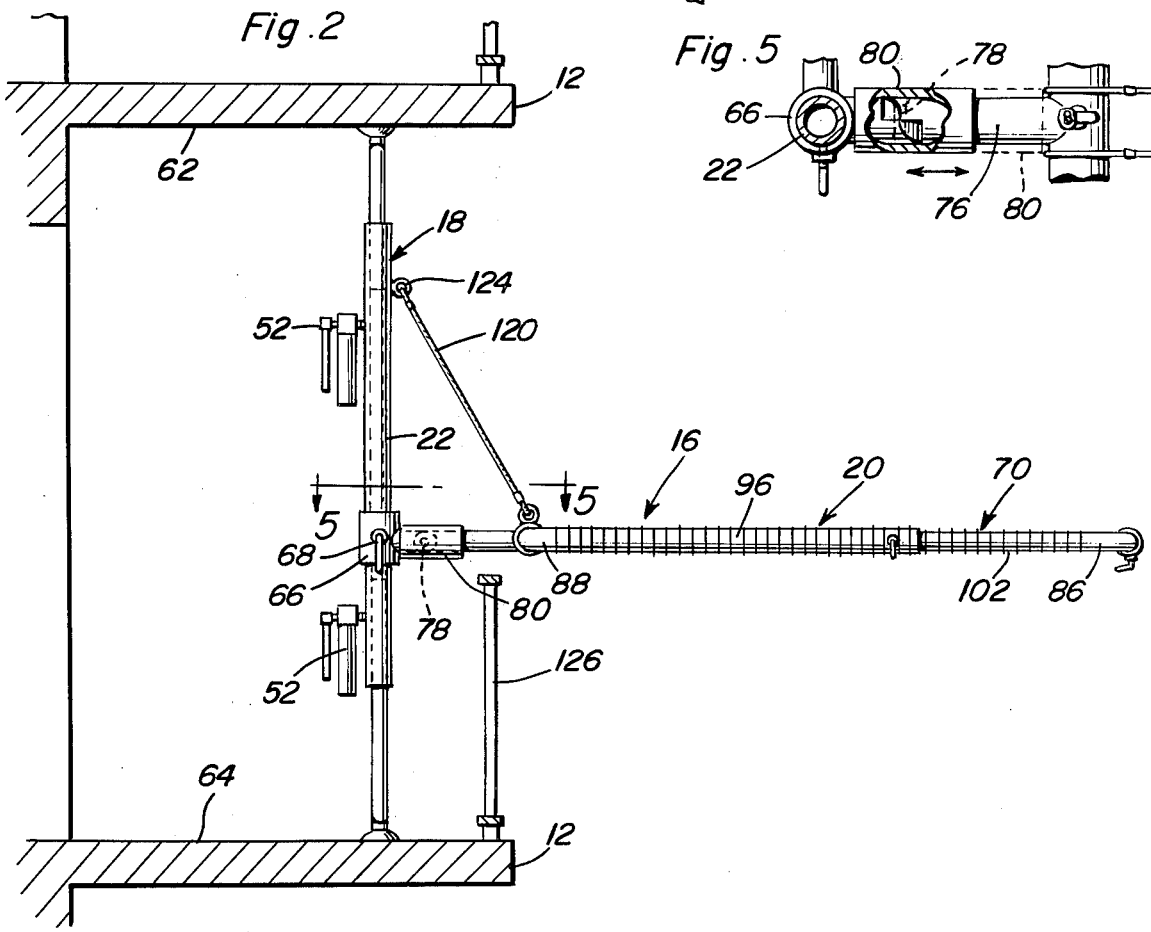
Fig. 5

Fig. 3
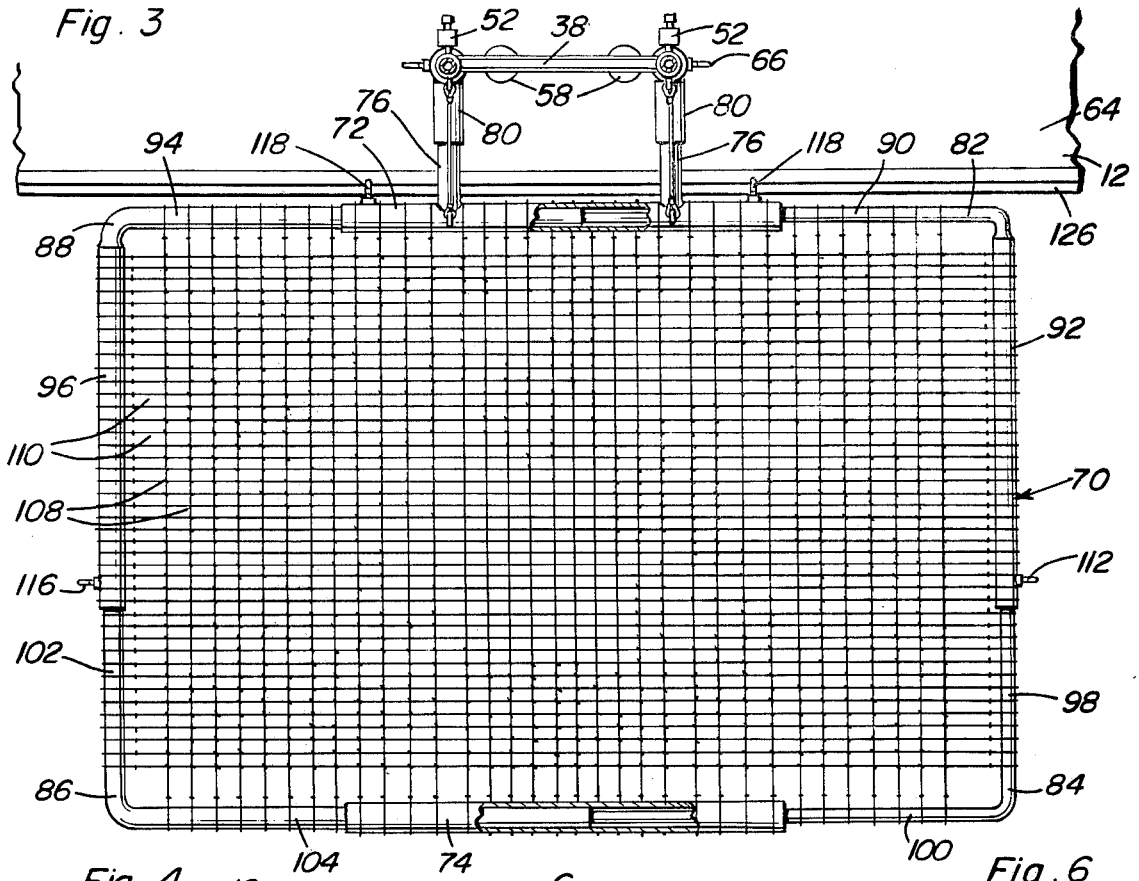
Fig. 4
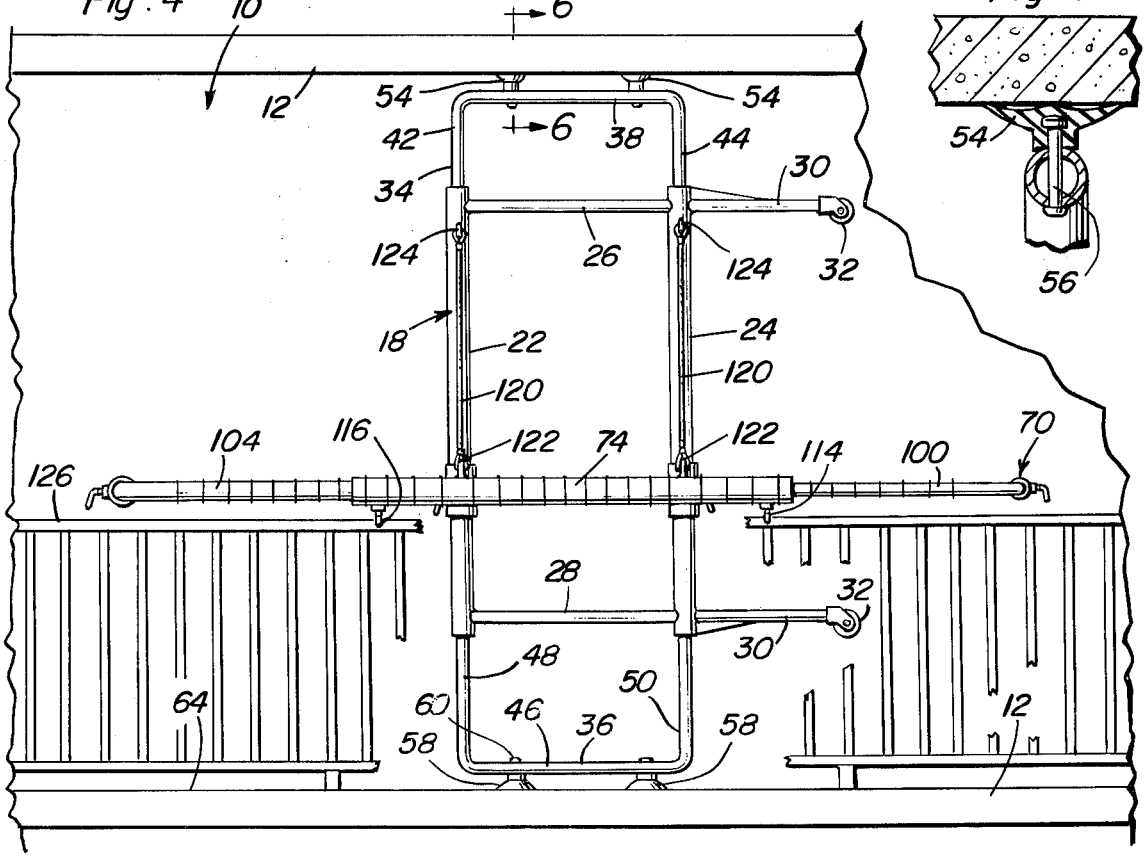
Fig. 6

EMERGENCY FIRE NET

BACKGROUND OF THE INVENTION

Various forms of catch structures for persons wishing to escape by the exterior of a tall building have been heretofore provided. However, these structures have not been constructed in a manner to be readily erected and supported in position between adjacent vertically spaced outwardly projecting balcony structures on the exterior of a building. The utilization of an occupant catch structure which is readily removably supportable between adjacent vertically spaced balcony structures enables persons on higher floors to drop into the catch structure and rescue personnel disposed on the lower balcony structure from which the catch structure is supported to assist persons landing in the catch structure.

Examples of previously patented emergency escape catch structures and other devices including some of the general structural and operational features of the instant invention are disclosed in U.S. Pat. Nos. 567,642, 1,012,947, 2,343,661 and 3,805,916; East German Pat. Nos. 36,542, 32,722, and 65,656; German Pat. No. 950,755; French Pat. Nos. 636,300, 1,387,326, 1,408,795, 1,435,582 and 1,490,572; and French Addition Nos. 71,253 and 944,002.

BRIEF DESCRIPTION OF THE INVENTION

The emergency escape net of the instant invention includes a vertically extendable upright mounting structure and a peripheral frame supported along one marginal edge portion thereof from a vertical mid-portion of the upright mounting structure for oscillation relative to the latter about a horizontal axis extending along the marginal edge portion of the peripheral frame between a horizontally outwardly projecting position and a position closely paralleling the upright mounting structure. The frame is generally rectangular in shape and is expandable both longitudinally and transversely with a generally horizontal and rectangular flexible net structure supported from and within the frame. When the vertically extendable upright mounting structure is in a vertically foreshortened condition and the net supporting frame is swung to a position closely paralleling the mounting structure and collapsed to its minimum dimensions the emergency escape net may be readily passed through existing doorways. Accordingly, a building equipped with one or more escape nets of the instant invention may have one or more escape nets erected immediately below the lowermost floor upon which an emergency situation such as a fire exists. Thus, if a fire exists on only one floor of a tall building persons may utilize the emergency net by merely dropping less than the height of one floor onto the net in escaping from the fire floor to the floor immediately therebelow. Furthermore, inasmuch as the emergency escape net is to be erected between adjacent vertically spaced balcony structures rescue personnel may be disposed immediately alongside the net to assist persons dropping onto the net from one or two floors thereabove.

The main object of this invention is to provide an emergency escape net structure for ready removable mounting between adjacent vertically spaced balcony structures of a tall building.

Another object of this invention is to provide an emergency escape net in accordance with the preceding object and constructed in a manner whereby the net structure may be readily transported through conventional size doorways of a building and through patio doors leading onto a balcony for use at substantially any desired level on a building equipped with vertically spaced balcony structures.

Still another object of this invention is to provide an emergency escape net in accordance with the preceding objects and constructed in a manner so as to provide a horizontally outwardly projecting catch structure of the net type extendable over conventional height railings and thus disposed at an easy working level for rescue personnel standing on the lower balcony of two adjacent vertically spaced balcony structures between which the emergency escape net is erected.

A final object of this invention to be specifically enumerated herein is to provide an emergency escape net in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a fragmentary perspective view of adjacent vertically spaced outwardly projecting balcony structures of a building between which the emergency escape net structure of the instant invention has been erected;

FIG. 2 is a fragmentary vertical sectional view of the assemblage illustrated in FIG. 1 as seen from the left side of the emergency escape net structure;

FIG. 3 is a fragmentary enlarged horizontal sectional view taken substantially upon the plane indicated by the section line 3—3 of FIG. 1 and with outer telescoping portions of the frame of the net being broken away and illustrated in section;

FIG. 4 is a front elevational view of the assemblage illustrated in FIGS. 2 and 3;

FIG. 5 is an enlarged fragmentary horizontal sectional view taken substantially upon the plane indicated by the section line 5—5 of FIG. 2;

FIG. 6 is an enlarged fragmentary vertical sectional view taken substantially upon the plane indicated by the section line 6—6 of FIG. 4; and FIG. 7 is a fragmentary side elevational view of a modified form of emergency escape net structure.

DETAILED DESCRIPTION OF THE INVENTION

Referring now more specifically to the drawings, the numeral 10 generally designates a high building including a plurality of vertically spaced horizontally outwardly projecting balcony structures 12. Of course, the balcony structures 12 include upper surfaces which are substantially horizontally aligned with floor levels of the building, the latter including doorway structures 14 leading out onto the balcony structures 12.

The emergency escape net structure of the instant invention is referred to in general by the reference numeral 16 and includes a vertically extendable upright mounting structure referred to in general by the reference numeral 18 and a horizontally outwardly projecting net structure referred to in general by the reference numeral 20. The mounting structure 18 includes a pair of uprights 22 and 24 interconnected at their upper and lower ends by horizontal tubular braces 26 and 28 secured therebetween. In addition, the uprights 24 include horizontally outwardly projecting leg members 30 aligned with the tubular braces 26 and 28 and provided with caster wheels 32 on their outer ends. The mounting structure 18 further includes upper and lower inverted and upright U-shaped members 34 and 36. The U-shaped member 34 includes an upper bight portion 38 interconnecting a pair of depending legs 42 and 44 and the U-shaped member includes a lower bight portion 46 interconnecting a pair of upstanding legs 48 and 50. The free ends of the legs 42 and 48 comprise piston members and are telescoped into the upper and lower ends of the upright 22 and the free ends of the legs 44 and 50 comprise pistons and are telescoped into the upper and lower ends of the uprights 24. Each of the uprights 22 and 24 includes an internal partition (not shown) and a pair of manually actuatable hydraulic pumps 52 thereon which may be manually operated to forcibly extend the corresponding legs of the U-shaped members. Further, the upper bight portion 38 includes a pair of opposite end upwardly facing foot structures 54 secured thereto by means of fasteners 56 and each lower bight portion 46 includes a pair of similar downwardly facing foot structures 58 secured thereto by means of fasteners 60. Accordingly, it may be seen that the mounting structure 18 may be vertically extended through the utilization of the hydraulic pumps 52 in order to frictionally engage and be wedged between the under and upper surfaces 62 and 64 of the upper and lower balconies 12.

Each of the uprights 22 and 24 includes a collar 66 slidably mounted thereon and equipped with a handled setscrew 68 whereby the collars 66 may be secured in position on the uprights 22 and 24.

The net structure 20 includes a rectangular frame referred to in general by the reference numeral 70 and the frame 70 includes inner and outer central longitudinal members 72 and 74 which are tubular in construction. A pair of horizontal support arms 76 are spaced along and project outwardly of the inner side of the inner central longitudinal member 72 and have their outer ends pivotally secured to the collars 66 and 78 for angular displacement of the frame 70 between the horizontal positions thereof illustrated in FIGS. 1–4 and an upstanding position closely paralleling the mounting structure 18. Further, a pair of collars 80 are slidably disposed on the support arms 76 between the phantom line position thereof illustrated in FIG. 5 of the drawings freeing the arms 76 for swinging relative to the collars 66 and the solid line positions thereof illustrated in FIG. 5 locking the support arms 76 against angular displacement from the horizontal positions thereof.

The frame 70 includes four L-shaped corner members 82, 84, 86 and 88. The corner member 82 includes a pair of right-angularly disposed arms 90 and 92 and the corner member 88 includes a pair of right-angularly disposed arms 94 and 96. The arms 90 and 94 are telescoped into the remote ends of the inner central longitudinal member 72 and the innermost end of the arm 90 is also telescoped into the free end of the arm 94. Further, the corner member 84 includes right-angularly disposed arms 98 and 100 while the corner member 86 includes right-angularly disposed arms 102 and 104. The free ends of the arms 98 and 102 are telescoped into the free ends of the arms 92 and 96, respectively, and the free ends of the arms 100 and 104 are telescoped into the opposite ends of the outer central longitudinal member 74, the free end of the arm 100 also being telescoped into the free end of the arm 104.

The net structure 20 additionally includes a plurality of parallel transverse flexible members 108 spaced longitudinally therealong and parallel longitudinal members 110 spaced transversely thereof. Certain of the transverse members 108 are connected and extend between the arms 90 and 100, other transverse members 108 extend between the central longitudinal members 72 and 74 and the remaining transverse members 108 extend between the arms 94 and 104. Further, certain of the longitudinal members 110 extend between and are secured to the arms 92 and 96 while the remaining longitudinal members 110 extend between the arms 98 and 102.

A releasable lock pin 112 is utilized to secure the arms 92 and 98 in extended positions, a pair of lock pins 114 and 116 are utilized to secure the arms 100 and 104 in the extended position, a lock pin 116 is used to secure the arms 102 and 96 in extended positions and a pair of lock pins 118 are used to secure the arms 90 and 94 in the extended positions. However, once the frame 70 is extended to the maximum dimensions allowed by the members 108 and 110 use of the various lock pins 112, 114, 116 and 118 is not required inasmuch as the lateral forces acting upon the various telescopic connections as a result of a person falling onto the members 108 and 110 from above will prevent any appreciable decrease in the length and width of the frame 70.

The frame 70 is braced relative to the uprights 22 and 24 by means of inclined braces 120 secured between anchors 122 carried by the inner central longitudinal member 72 and anchors 124 carried by the upper ends of the uprights 22 and 24.

Inasmuch as the collars 66 are adjustable along the uprights 22 and 24 the elevation of the frame 70 in relation to the upper edge of a railing structure such as the railing structure 126 of the lower balcony 12 may be adjusted.

From the foregoing it is believed readily apparent that the frame 70 may be collapsed to minimum length and width dimensions and pivoted to a position paralleling the outer side of the mounting structure 18. Then, with the frame 70 pivoted to the inoperative position the emergency escape net structure 16 may be angularly displaced 90 degrees so as to place the caster wheel assemblies 32 lowermost. In this position, the structure 16 may be readily rolled through the building 10, after the U-shaped members 34 and 36 have been fully collapsed.

With attention now invited more specifically to FIG. 7 of the drawings, there will be seen a modified form of emergency escape net structure referred to in general by the reference numeral 16' and which includes numerous components that are substantially identical to corresponding components of the net structure 16 and are therefore designated by corresponding prime numerals. The net structure 16' differs from the net structure 16 in that lower inclined braces 17 are connected between the lower ends of the uprights 22' and 24' and the frame 70'. Further, the structure 16' additionally includes lengthwise adjustable upwardly and inwardly projecting brace members 19 having their lower ends pivotally attached to the collars 66' and their upper ends provided with V-shaped anchors 21 seatable in the downward and outward corner portions defined between the underside of the upper balcony structure 12' and the outer surface of the adjacent wall of the building 10'. Of course, it will be noted that the braces 17 are received between adjacent vertical members of the railing 126'.

As an alternate to the telescoping connections between arms 90, 94 and longitudinal member 70 and between arms 100, 104 and longitudinal member 74, hinge connections such as those used at 78 may be used.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In combination, a generally planar upright mounting structure including a pair of parallel tubular uprights and upper and lower brace members extending and secured between the upper and lower ends of said uprights, relatively inverted upper and lower U-shaped members each including parallel legs and a bight portion extending between and connecting one pair of corresponding ends of the legs thereof, said U-shaped members having their legs telescopingly engaged within the upper and lower ends of said uprights, positioning means interconnected between said U-shaped members and said tubular members for adjustably extending the former relative to the latter, a pair of collars mounted on said uprights between said brace members for adjustable positioning along said uprights and including means operative to releasably lock said collars in adjusted positions along said uprights between said upper and lower brace members, a generally horizontal support frame pivotally supported from said collars and projecting outwardly from one side of said mounting structure with said frame swingable relative to said mounting structure about an axis paralleling a path extending between said collars between a first operative horizontal position disposed generally normal to said mounting structure and an inoperative vertical position closely adjacent and generally paralleling said mounting structure, said frame being generally rectangular in configuration and longitudinally and transversely extendable and retractable in directions extending along and transverse to said axis, respectively, a flexible catch structure secured across said frame, means operative to releasably secure said frame in said operative position, brace structure connected between said mounting structure and an outer portion of said frame releasably bracing said frame in said operative position against downward swinging of the outer portion of said frame relative to said mounting structure, one of said uprights including upper and lower leg members supported from the upper and lower ends thereof and projecting horizontally outwardly from the side of said one upright remote from the other upright, the outer ends of said leg members including supporting wheel means journaled therefrom, said frame, when extended longitudinally, projecting outwardly beyond the free ends of said leg members and, when longtiudinally retracted, terminating inwardly of the free ends of said legs, said collars being shiftable along said tubular uprights to positions closely adjacent the lower ends thereof, whereby when said U-shaped members are retracted relative to said uprights and said frame is swung to said inoperative position, said mounting structure may be positioned with said wheel means lowermost and rolled over a horizontal support surface with said frame and mounting structure disposed in closely superposed registry with each other.

2. The combination of claim 1, including a pair of extendable and elongated brace means pivotally attached at their lower ends to said collars and including upper end means for seating in a downwardly and outwardly opening corner defined by the intersection of the undersurface of an outwardly projecting balcony and the wall from which it projects.

3. The combination of claim 1, wherein said bracing structure is flexible.

4. The combination of claim 1, wherein said bracing structure includes rigid bracing members extending and secured between said frame and portions of said uprights spaced below said frame.

5. The combination of claim 1, wherein said flexible catch structure is secured between opposite sides and ends of said frame and limits expansion of said frame both longitudinally and transversely.

6. The combination of claim 1, wherein said positioning means includes fluid motor means for extending said U-shaped members.

* * * * *